US007120949B2

(12) United States Patent
Wilburn

(10) Patent No.: US 7,120,949 B2
(45) Date of Patent: Oct. 17, 2006

(54) MULTI-PURPOSE DRAIN

(76) Inventor: Robert George Wilburn, 609 41st St., Rock Island, IL (US) 61201

( * ) Notice: Subject to any disclaimer, the term of this patent is extended or adjusted under 35 U.S.C. 154(b) by 309 days.

(21) Appl. No.: 10/862,145

(22) Filed: Jun. 7, 2004

(65) Prior Publication Data

US 2005/0268396 A1 Dec. 8, 2005

(51) Int. Cl.
*E03C 1/26* (2006.01)

(52) U.S. Cl. ..... 4/679; 4/256.1; 137/247.11; 137/247.45; 210/311; 210/533

(58) Field of Classification Search ..... 4/256.1, 4/679; 137/247.11, 247.41, 247.45; 210/311, 210/411, 533
See application file for complete search history.

(56) References Cited

U.S. PATENT DOCUMENTS

| | | | | |
|---|---|---|---|---|
| 237,469 | A * | 2/1881 | Bergeman | 210/311 |
| 246,453 | A * | 8/1881 | Brandeis | 137/247.11 |
| 425,641 | A * | 4/1890 | Van De Walle | 210/311 |
| 1,171,408 | A * | 2/1916 | Barstow | 210/311 X |

* cited by examiner

*Primary Examiner*—Robert M. Fetsuga
(74) *Attorney, Agent, or Firm*—Robert Wilburn

(57) ABSTRACT

The purpose of this multi-purpose drain is to prevent foreign matter from intruding into the down stream drainage system while providing a means to maintain the flow of liquid through the system should the primary path of flow become clogged. This invention has a wide variety of uses in all industries and can help individuals of diverse backgrounds maintain their drain piping system. The breakthrough and background of this invention relates directly to the beverage service and hotel service industries. I contend that this product can significantly reduce the labor and maintenance costs of drainage systems of all types. It can be used universally by the homeowner and maintenance professional alike.

8 Claims, 4 Drawing Sheets

MULTI-PURPOSE DRAIN

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF INVENTION

The invention relates to traps in low-pressure drain plumbing applications, in particular to readily cleanable traps which function as gas traps and those that capture heavy sediment and trash that flow into the trap itself. This particular design incorporates an overflow mechanism that allows the drain to keep flowing in the event that the trap portion of the drain becomes clogged and does so without violating the integrity of the gas trapping feature desired in drain traps.

Various styles of traps that prevent the escape of sewer gas through the drain have been available since the beginnings of indoor plumbing. The P and S style traps are those most commonly used over the last century. A trap that provides a removable cup is exhibited in U.S. Pat. Nos. 1,210,201 and 4,700,412. Other types of cleanable traps are shown in U.S. Pat. Nos. 2,742,101, 3,994,031, 2,170,390, and 919,701.

BRIEF SUMMARY OF THE INVENTION

The general purpose of all traps in plumbing systems is to maintain a barrier so that sewer gases do not back up into occupied spaces. The above mentioned patents exemplify this very well. All are capable of maintaining the gas barrier as well as supplying a means of cleaning out obstructions. Typically, when an obstruction is discovered, it is noticed when a large quantity of water or other drain waste is backed up in the associated sink or drainage fixture. The purpose of the present invention is to maintain flow through the drain in the event that the trap catch area becomes clogged or restricted. The purpose of maintaining flow is to decrease the possibility of build up down stream of the trap fixture and to decrease the amount of fluid released when cleaning out the trap catch area. The trap catch area has a removable cap that is accessed to remove the trash, sediment, or valuable caught within the section. This invention can replace existing traps of today. It has a great potential to serve the home, service, and industrial sectors.

It is the object of this invention to provide a multi-purpose trap design with numerous applications that is inexpensive to build, can be built from any type of material used in plumbing systems, easily cleanable, and helps to maintain the integrity of entire drainage systems by trapping/collecting all types of foreign matter and preventing their carriage into the system.

A further object of this invention is to provide an overflow means to maintain the flow of fluid through the drainage system when the primary flow path is restricted or clogged.

A further object is to provide a wide size variation within the product line to allow for its use in any drain application and space requirement.

Another object is to provide the gas trap feature associated with common plumbing practice today.

A further object of this invention is to provide today's home owners, facilities operators, and maintenance gurus an easy means of removing trash collected in drain assemblies, of removing valuables lost down sinks and other drainage fixtures, and of maintaining the integrity of their drainage systems while providing them with a durable, easily installed and maintained product.

These and other objects will become more apparent to those skilled in the art upon reviewing the summary of this invention in addition to a study of the preferred embodiment described hereafter.

Operation

The theory of operation of this unit is simple. The inlet tube is attached directly to the drain. In a sink installation, it would attach directly to the sink basket installed on the basin. Foreign matter falls in to the open side of the drain and becomes trapped by the cup and the open side. Water continues to flow through the drain screen in the lower portion of the drain. As the drain remains in service, the open side begins to fill with foreign matter. With proper maintenance, the drain is cleaned regularly and the drain operates as normal. If the drain is not maintained, it continues to prevent foreign matter from entering the drainage system. At some point, the lower portion of the drain will become clogged, flow through the drain screen will cease. Water now backs up inside the drain. As the water fills the drain, it will eventually reach the overflow; at which time it will overflow into the overflow portion of the drain and enter the outlet through this path. The reduction of the size of the overflow tube will cause reduced flow in the sink signaling the user that the drain needs cleaned.

The use of this product is as a maintenance tool. Cleaning of the drain is a must to maintain the integrity of the unit. However, even in situations of extreme neglect, the drain prevents the entrance of foreign matter in to the drainage system. This is the ultimate failure of drainage systems in general. The initial problem that led to this invention was the intrusion of foreign matter into drainage systems in the beverage (bar) industry. The body of the can is designed to the length of the stir sticks used at the bar. By designing this way, the straw is allowed to completely fall into the drain to avoid obstructing the inlet tube. The easily cleanable trap lends itself to many industries and to homeowners alike. If a valuable is dropped, simply remove the cap and retrieve. Not tools required. No aligning of the old P-trap. Put the cap back on and the drain is ready.

DESCRIPTION OF THE PREFERRED EMBODIMENT

Figure 1:
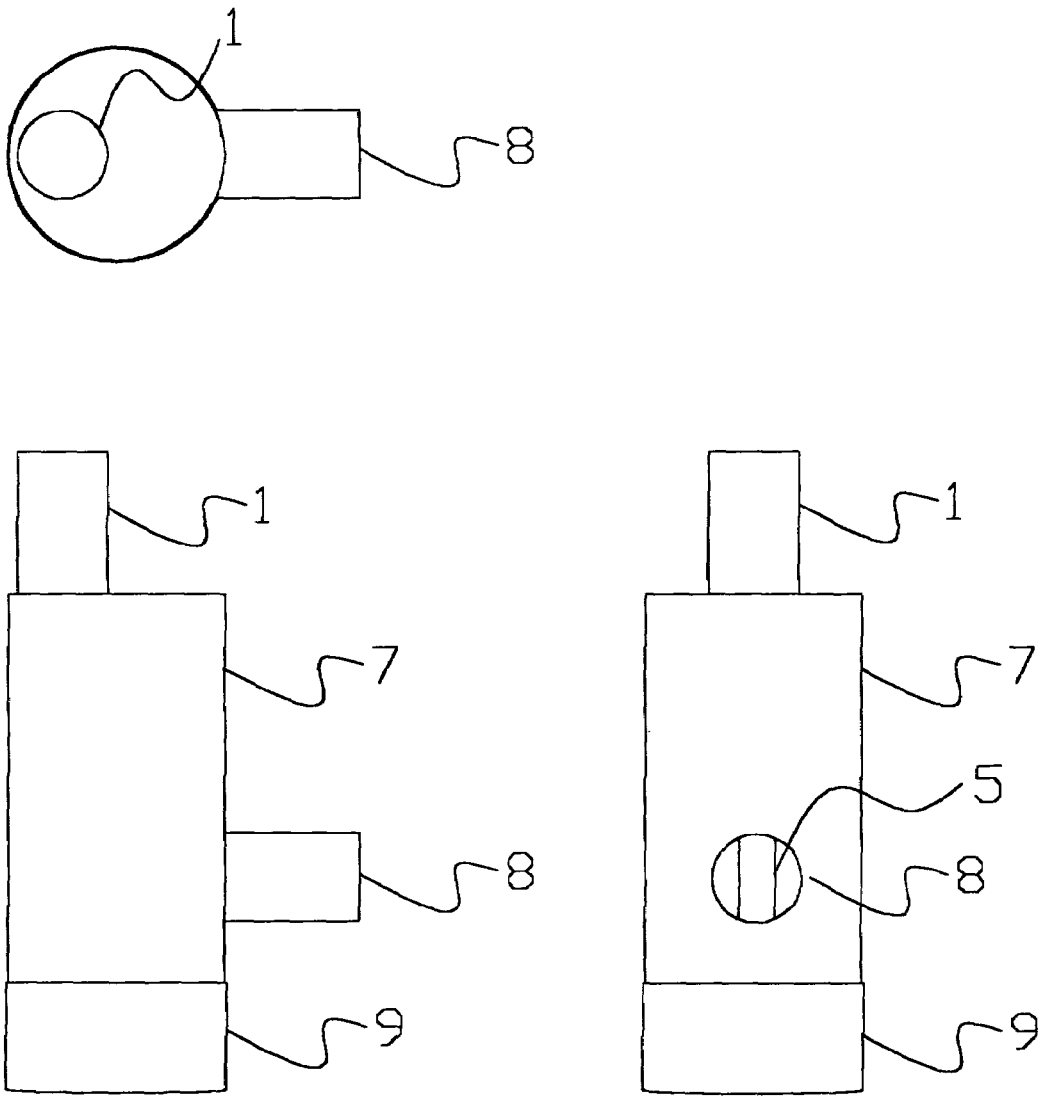
FIG. 1 is an external top, front, and side view of the assembled invention.
Figure 2:
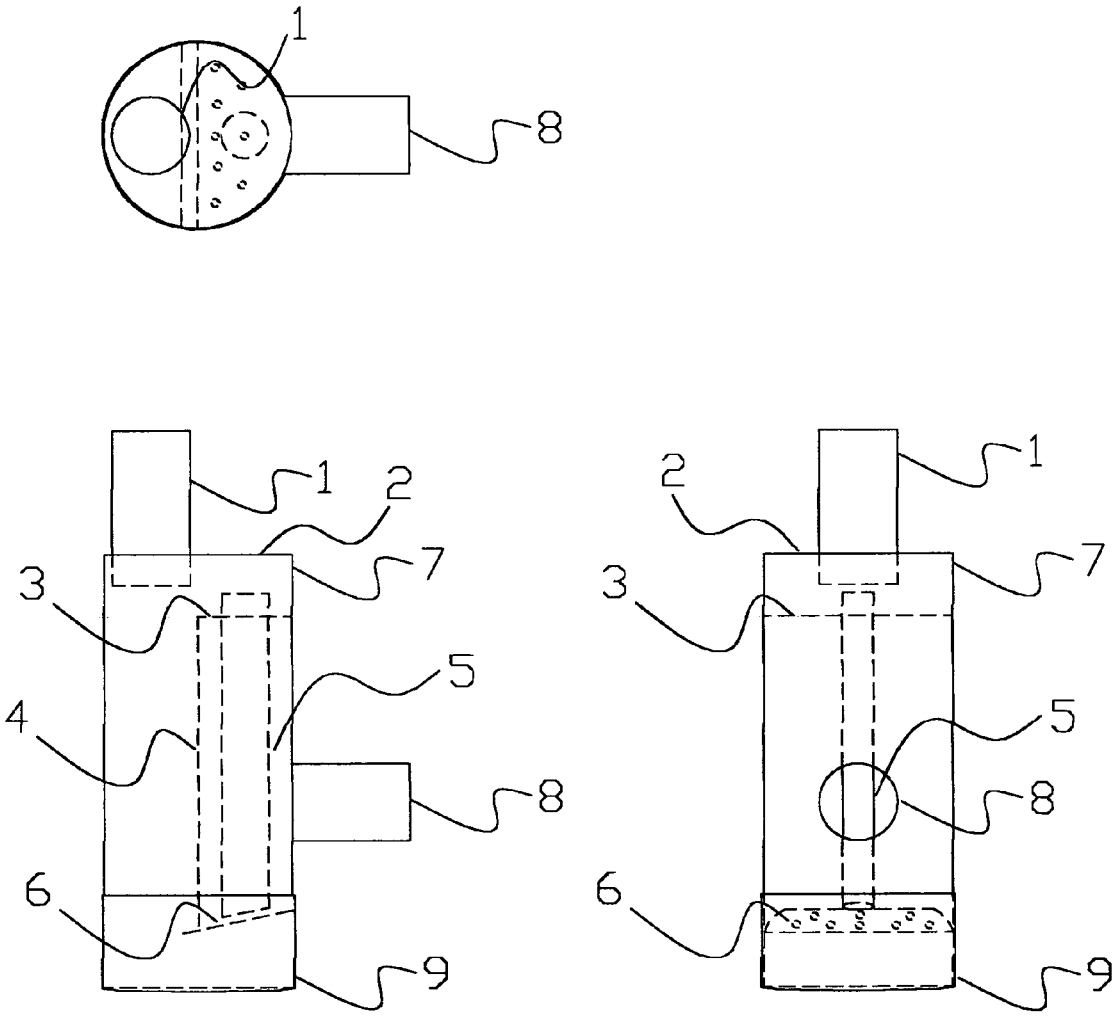
FIG. 2 is an overall top, front, and side view of the assembled invention showing all parts internal to the invention.
Figure 3:
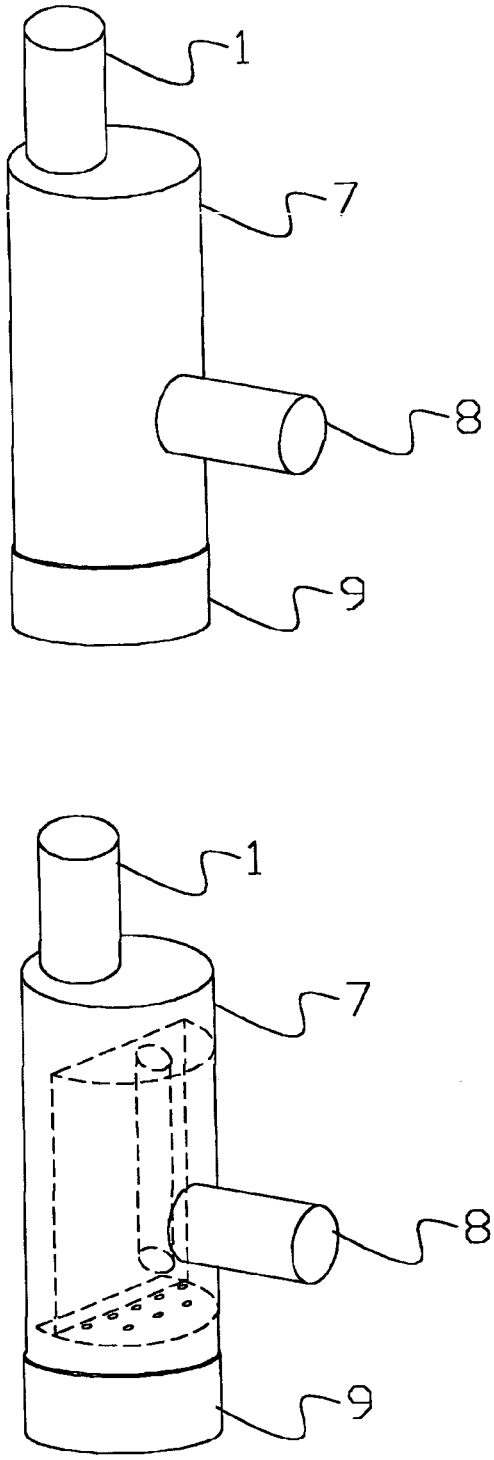
FIG. 3 is a perspective view of the invention showing the external view and internal (hidden) components of the invention.
Figure 4:
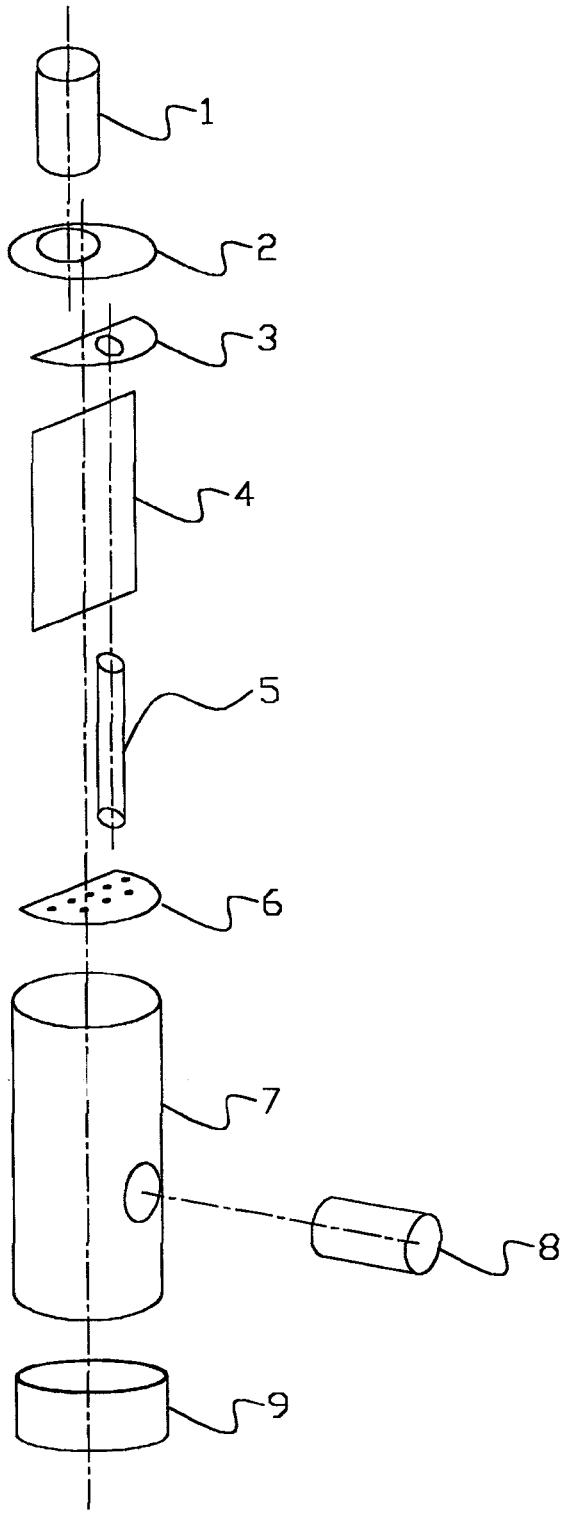
FIG. 4 is an exploded view of the invention showing all parts and their order of assembly.

In each figure, the numeral given to an individual part is the same as it is on any other drawing. This will allow for easy reference between drawings for those skilled in the art. Those skilled in the art can see how easily this design is adapted to all material forms including but not limited to PVC, Copper, steel, and stainless steel.

Referring to the drawings, the multi-purpose drain consists of a hollow body given as reference number 7, the length of the body is determined by the application for which it is intended. In our early research, we tested the invention in a bar installation to which we designed the body length to the length of the straws used at the bar. The unit has a sealed top given by numeral 2 which has an opening cut into it for inlet tube 1. Inlet tube 1 is inserted through sealed top 2 a distance equal to the depth of the overflow top plate 3 inside of hollow body 7. The hollow body 7 has an opening cut in it at some distance (approximately one-third (⅓) the length of the body to the lower end of outlet tube 8) above the lower end of overflow tube 5 to accommodate outlet tube 8. This is an important element of the gas trapping feature. The lower edge of outlet tube 8 sets the water level as contained in hollow body 7; therefore the lower end of overflow tube 5 must extend beyond the water line maintained in the body. On the lower end of hollow body 7 is removable cup 9. Removable cup 9 is the trash catch portion of this drain. In our current proto-type unit, removable cup 9 is a plastic or rubber cap; we have also used pipe caps and plugs in larger proto-type units. Sealing on the product can be done by welding, soldering, or chemical cementing depending upon the material and application you wish to use.

Internally, the multi-purpose drain consists of overflow top plate 3, hollow body divider 4, drain plate 6, and overflow tube 5. Divider 4 is positioned within one-eighth (⅛) of the length of the hollow body from sealed top 2. Divider 4 is five-eighths (⅝) the length of the hollow body 7 and is positioned inside hollow body 7 so that equally divides a trash catching (open) section and an overflow section the unit vertically into. Overflow top plate 3 is positioned a top of divider 4. Overflow top plate 3 has a hole, centrally located, cut into it for the insertion of overflow tube 5. Overflow tube 5 is to be 2.0 to 2.5 times smaller than the inlet and the outlet tubes. (For example: 1¼" PVC inlet yields ½ " PVC overflow tube size) Overflow tube 5 is inserted into overflow top plate 3. Overflow tube 5 must protrude above overflow top plate 3 at least one-eighth the distance between sealed top 2 and overflow top plate 3. The length of overflow tube 5 should be such that it extends below the lower edge of outlet tube 8. The lower end of overflow tube 5 is cut and a minimal angle to match that of the angle drain screen 6. Drain screen 6. The inlet tube 1 and outlet tube 8 have an outside diameter of no more than one-half (½) the inside diameter of the hollow body 7. is the final piece of the internal components. Drain screen six has eight (8) one-eighth inch (⅛") holes drilled into to allow for the passage of liquid through it. Drain screen 6 is positioned on the lower end of divider 4; it should have an overhang of not more that ¼" into the open side of hollow body 7. Drain screen 6 is positioned inside of hollow body 7 at an angle sloping from the lower end of divider 4 upward toward hollow body 7 and terminate below outlet tube 8. The angle of drain screen 6 can vary from 10 to 15 degrees from horizontal.

What I claim as my invention is:

1. A multi-purpose drain comprising a hollow body, with a sealed top having an inlet tube inserted through it, an outlet tube positioned on the opposite side of the inlet, and having a removable cap on the lower end to seal the body the body internally comprising two distinct sections separated by a divider, a trash catching (open) section and an overflow section; the overflow section comprising an overflow top plate with an overflow tube passing through it and a drain screen on the lower section of the of the divider.

2. A multi-purpose drain as set forth in claim 1 wherein the lower end of the outlet tube is positioned one-third (⅓) the overall body length above the lower end of the body.

3. A multi-purpose drain as set forth in claim 1 wherein the overflow tube extends above the overflow top plate by a minimum distance of one-eighth (⅛) the distance between the sealed top and the overflow top plate.

4. A multi-purpose drain as set forth in claim 1 wherein the internal overflow tube has a minimum working diameter of one-half (½) the size of the inlet and outlet tube working diameter.

5. A multi-purpose drain as set forth in claim 1 wherein the inlet and outlet tube have an outside diameter of no more than one-half (½) the inside diameter of the hollow body.

6. A multi-purpose drain as set forth in claim 1 wherein the drain screen includes a plurality of holes drilled through it for drainage.

7. A multi-purpose drain as set forth in claim 1 wherein the screen on the lower end of the divider extends no more that one-quarter inch (¼") into the trash catching (open) section.

8. A multi-purpose drain as set forth in claim 1 wherein the divider is five-eighths (⅝) the length of the hollow body, and that is positioned within one-eighth (⅛) of the length of the hollow body from the sealed top of the drain.

* * * * *